United States Patent [19]

Pasich

[11] 4,123,854

[45] Nov. 7, 1978

[54] SKI BOOT ATTACHMENT FOR FACILITATING WALKING

[76] Inventor: Daniel D. Pasich, 1501 N. Wakonda St., Flagstaff, Ariz. 86001

[21] Appl. No.: 821,622

[22] Filed: Aug. 3, 1977

[51] Int. Cl.[2] ..... A43B 5/00; A43B 3/10

[52] U.S. Cl. ..... 36/7.5; 36/132

[58] Field of Search ..... 36/7.5, 7.6, 132, 136; 12/120

[56] References Cited

U.S. PATENT DOCUMENTS

| | | | |
|---|---|---|---|
| 1,851,778 | 3/1932 | Skillen | 36/7.5 |
| 2,292,263 | 8/1942 | Amlaw | 36/7.5 |
| 2,747,300 | 5/1956 | Field | 36/7.5 |
| 3,665,620 | 5/1972 | St. Clair | 36/7.5 |

*Primary Examiner*—Patrick D. Lawson

*Attorney, Agent, or Firm*—Weingram & Klauber

[57] ABSTRACT

An attachment for securing to a conventional ski boot to facilitate safe walking by a wearer. The device comprises a generally elastic member adapted to receive the bottom of the ski boot, the member including a first portion for receiving the toe of the boot and a second portion for receiving the heel of the boot, together with an intermediate portion extending between the toe and heel-receiving portions. The toe and heel portions each include a platform projecting below the intermediate portion. Such platforms contact the ground during the wearer's walking to enable movement of the foot and limb in a manner simulative of normal walking, without, however, requiring flexure of the boot. The platform at the heel portion is substantially thicker than that at the toe portion, typically being approximately twice the thickness of the toe platform. Both toe and heel platforms preferably comprise a resilient material such as sponge rubber. The bottom of each of the platforms may further, be provided with an irregular surface, e.g., rippled or corrugated, in order to increase frictional engagement with the ground. A layer of hard rubber carrying such irregularities may thus be laminated to the overlying sponge rubber.

11 Claims, 3 Drawing Figures

SKI BOOT ATTACHMENT FOR FACILITATING WALKING

BACKGROUND OF INVENTION

This invention relates generally to sporting and athletic goods, and more specifically relates to apparatus useful in faciliatating safe walking by a skier while the latter is wearing conventional ski boots.

Conventional ski boots, including especially the more modern varieties thereof, are intentionally designed to be of generally inflexible construction. Indeed many modern ski boots are of substantially one-piece construction, and include a sole which is essentially inflexible. While such boots are deemed admirably suited to their primary purpose, i.e., as a means for effectively coupling the wearer's feet to his skis, the wearer finds that such boots are quite unadapted to walking once the wearer steps from his skis. Indeed, it is a markedly difficult operation for the skier to even progress the short distance often required in endeavoring to walk from a ski slop to a lodge or to a parked automobile.

The cited boot inflexibility, when further coupled with the fact that the bottom of the boots are commonly relatively flat, tends further, to make walking not only difficult, but also dangerous. This, of course, is especially the case in the environments in which such boots are employed, i.e., in the presence of snow and/or ice.

It may be further noted that if the wearer of such conventional boots does successfully and safely traverse the distance from his vehicle to the ski slope, he frequently finds that his boots have become caked with snow and ice. Before he can engage his skis, however, the encrusted snow and ice must be removed, but it is found that the process of dislodging same can be most awkward and even unsafe when the user is already encumbered with skiing equipment.

From time to time, it has been proposed to utilize devices attachable to a ski boot or the like, in order to facilitate walking and/or to improve the safety of walking in such boots. By and large, however, these approaches have met with quite limited success. E.g., it has been known to attach so-called "ice-creepers" to ski boots or to other types of boots or shoes. Such devices often include spikes, cleats or the like intended to grasp the underlying surface, which may be ice. While devices of this type do indeed increase the safety incidence to walking upon ice or snow, they do not simulate normal walking; and are quite unsafe for use on conventional surfaces such as indoors or in automobiles or other vehicles. There have also been attempts to develop devices for specific use with ski boots, which devices are intended to provide a foot motion in the wearer simulative of that experienced in normal walking. Reference may be had in this connection, e.g., to U.S. Pat. No. 3,665,620, which discloses an unusually configured walking member, which attaches to and depends from the sole of a ski boot, and is so shaped as to provide a forward rocking motion to the ski boot during the user's normal stride.

In general, however, known prior devices have not achieved a high degree of acceptance, as will be evident from the observable, very limited use of such devices in the relevant field.

In accordance with the foregoing, it may be regarded as an object of the present invention to provide a ski boot attachment, which is of simple, low-cost construction, and which when secured to a conventional ski boot, facilitates the wearer's normal walking by introducing motion to anatomical portions of the user which is simulative of that generated in normal walking.

It is a further object of the invention, to provide a ski boot attachment as above, which includes features intended to render walking safer, by increasing frictional engagement with the underlying ground.

It is a still further object of the present invention, to provide a ski boot attachment of the foregoing character, which is readily attached to and removed from the boots by the user, and which can thereby serve to preclude the snow and ice accumulation which would otherwise collect upon the boots during the wearer's walking in same.

It is yet an additional object of the present invention, to provide a ski boot attachment which when secured to a conventional ski boot, facilitates walking; which may be attached to a conventional boot in simple fashion; and which is adapted for use with boots of various sizes.

SUMMARY OF INVENTION

Now in accordance with the present invention, the foregoing objects, and others as will become apparent in the course of the ensuing specification, are achieved in a ski boot attachment which is adapted for modifying a conventional ski boot to facilitate safe walking by a wearer. The device comprises a generally elastic member adapted to receive the bottom of the ski boot, the member including a first portion for receiving the toe of the boot and a second portion for receiving the heel of the boot, together with an intermediate portion extending between the toe and heel-receiving portions. The toe and heel portions each include platforms projecting below the intermediate portion. Such platforms contact the ground during the wearer's walking to enable movement of the foot and limb in a manner simulative of normal walking, without, however, requiring flexure of the boot. The platform at the heel portion is substantially thicker than that at the toe portion, typically being approximately twice the thickness of the toe platform. Both toe and heel platforms preferably comprise a resilient material such as sponge rubber. The bottom of each of the platforms may further be provided with an irregular surface, e.g., rippled or corrugated, in order to increase frictional engagement with the ground. A layer of hard rubber carrying such irregularities may thus be laminated to the overlaying sponge rubber.

The walking attachment may also include means for securing same to portions of the boot. Such means may include rings secured to the toe and heel-receiving portions, with connecting straps including snap fasteners extending between the rings and the boot portions to which the device is thus secured.

BRIEF DESCRIPTION OF DRAWINGS

The invention is diagrammatically illustrated, by way of example, in the drawings appended hereto, in which.

DESCRIPTION OF PREFERRED EMBODIMENT

Figure 1:
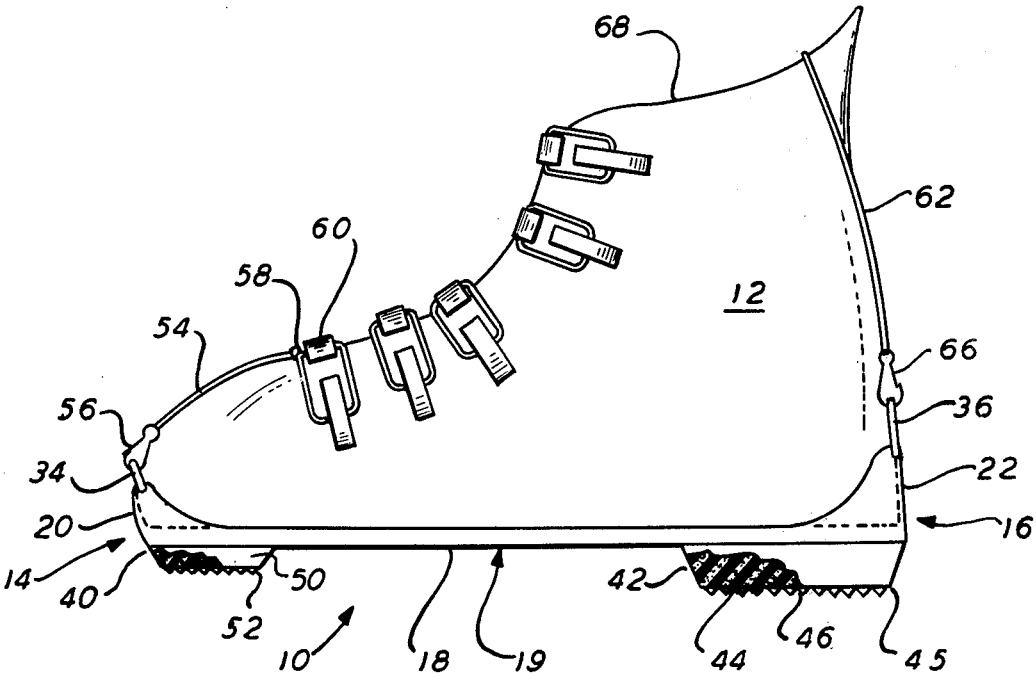
FIG. 1 is a side elevational view of a ski boot attachment in accordance with the present invention, the said device being shown in use in conjunction with a conventional ski boot.
Figure 2:
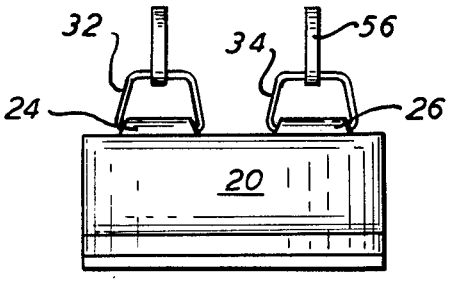
FIG. 2 is a front elevational view of the device in FIG. 1.
Figure 3:
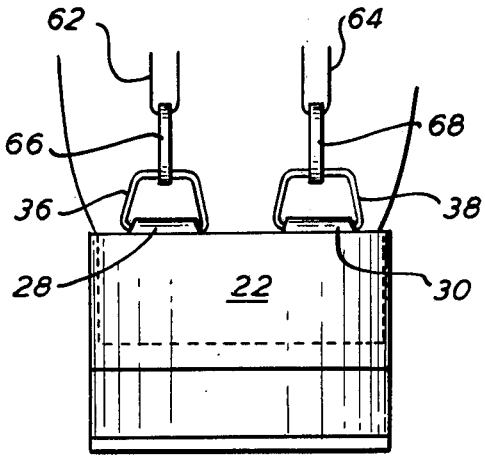
FIG. 3 is a rear elevational view of the said device.

In FIG. 1 herein, a ski boot attachment or device 10 in accordance with the invention appears. The said device is shown being used in conjunction with and attached to a conventional ski boot 12. The view of FIG. 1 may be considered simultaneously with the front and rear elevational views of FIGS. 2 and 3, in order to gain a full appreciation of the nature of the invention.

It will, of course, be understood in connection with this discussion, that the boot 12 in no way constitutes part of the present invention; but is rather a completely conventional bit of apparel. In order to appreciate the significance of the invention, however, it may be noted that many modern ski boots (as well as, in many instances, more antiquated models) are noteworthy for their rigid construction. Indeed, in many instances, these modern boots are effectively of one-piece construction; e.g., in some instances they are actually molded as one piece; and such boots are intentionally provided with a quite inflexible, essentially planar sole. Device 10 is of generally elastic construction, e.g., of rubber or the like, and is seen to include a boot toe-receiving portion 14 at the forward end thereof, and a boot heel-receiving portion 16 at the rear thereof, with an intermediate portion 18 extending therebetween.

The intermediate portion 18 is preferably formed of a stretchable, relatively soft rubber; and as seen in FIG. 1, portion 18 is actually part of a sole piece 19 which extends the length of device 10, with its forward portion being part of toe-receiving portion 14 and its rearward portion being part of heel-receiving portion 16. It is further seen that a wall 20 extends upwardly from the edges of sole piece 19 at toe-receiving portion 14; and that a similar wall 22 extends upwardly from the sides of sole piece 19 at heel-receiving portion 16.

Walls 20 and 22, which thus are seen to flare upwardly at the front and rear of device 10, serve to define recesses for the toe and heel portions of boot 12. Since walls 20 and 22 are, as indicated, quite stretchable, the said toe and heel of the boot is readily received into the said recesses—regardless of variations in the width and/or configurations of the toe and heel portions of boots with which device 10 may be associated.

Similarly, of course, it will be evident by virtue of the stretchable nature of the rubber material used for sole piece 19, that the intermediate portion 18 is quite extensible; hence portions 14 and 16 may be displaced away from each other to a sufficient degree to accomodate virtually any standard size boot.

It will further be seen that the upwardly extending walls 20 and 22 may include at the tops thereof molded-in ring receiving portions 24, 26, 28 and 30. Rings 32, 34, 36 and 38 may be secured to these receiving portions, which rings in turn serve to engage spring fasteners, as will be discussed hereinbelow.

The toe-receiving portion 14 and heel-receiving portion 16, respectively include downwardly extending pads or platforms 40 and 42. Referring, for example to the platform 42 at heel-receiving portion 16, such platform is seen to be principally defined by a relatively thick layer 44 of resilient material, preferably sponge rubber. This sponge rubber layer can, for example, be directly laminated to the overlying portion of sole piece 19, or, in some instances, can be manufactured integrally therewith. The bottom surface of platform 42 is seen to be rippled or corrugated, as indicated at 46. Preferably, this rippled or corrugated surface can be defined by a separate layer 45 of molded, hard rubber, which can be laminated or otherwise secured to the overlying spongy layer 44.

Referring further to the toe-receiving portion 14, it is seen that the platform 40 is structured in a manner generally similar to platform 42, except that the thickness of platform 40 (i.e. its vertical dimension) is such that it only projects about one-half as far as does platform 42 from the bottom of piece 19. As indicated, however, the same basic structures may be present in platform 40, including a spongy resilient layer 50, laminated or otherwise affixed to the overlying portion of sole piece 19, and a corrugated or rippled hard rubber layer 52, secured as by heat lamination or the like to the spongy layer 50.

In use, the device 10 can be directly secured to the ski boot 12 by the wearer simply inserting the boot into the toe and heel-receiving portions 14 and 16, while stretching intermediate portion 18 and walls 20 and 22 to accomodate the particular boot. Once thus emplaced, the sole of boot 12 resides in contact with sole piece 19. In order to assure that device 10 is well secured to boot 12, and as already mentioned, fastener straps may be utilized. Thus, for example, one such fastener strap 54 including a conventional spring fastener 56 at its lower end, is shown with the fastener secured to the ring 34. The strap 54 may be of elastic construction, and a second spring fastener 58 at the far end thereof is secured to a portion of the boot, as, for example, to a portion of the boot clasp 60. While only one such strap 54 is seen in FIG. 1, clearly two may be utilized, one each associated with rings 32 and 34.

At the rear end of device 10, a similar pair of stretchable straps, 62 and 64 may be utilized, with the lower ends thereof being secured by spring fasteners 66 and 68 to the rings 36 and 38. The upper ends of straps 62 and 64 may include similar spring fasteners (not seen in plane of drawing) which can engage with the top portion 68 of the boot, or can be secured to other convenient point.

It will especially be noted from consideration of the Figures herein, that a significant height differential is provided, as between the toe-receiving platform 40 and the heel-receiving platform 42. As already mentioned, platform 42 may typically have a thickness or height such that same extends beneath the plane of portion 18, approximately twice the distance as does platform 40. Thus, in a typical instance, the heel platform may have a height of approximately one inch, whereas the toe platform will have a height of ½ inch. In consequence of this arrangement, and further by virtue of the spongy, resilient nature of layers 44 and 50, the wearer of boot 12 experiences when walking with device 10, a clear simulation of the experience achieved during normal walking—i.e. in "normal" shoes or the like.

The present arrangement further, by virtue of the rippled or corrugated surface at the bottom of the portions 14 and 16, provides an efficient means to increase the co-efficient of friction between the present device and the underlying surface on which the wearer walks—which surface may of course include ice and/or snow. Since contact with the ground primarily is effected by the front and rear of device 10, i.e., at the rippled surfaces, the contact pressure between the rippled surfaces and ground is very high. The frictional engagement with the ground is thus augmented, to further provide safety of walking.

It, of course, will be appreciated that the rippled or corrugated surfaces 46, while preferably provided of the hard rubber layers indicated, can be enabled by other arrangements, such as by small projections, or by cleats or the like.

While the present invention has been especially illustrated in terms of specific embodiments thereof, it will be understood in view of the instant disclosure that numerous variations upon the invention are now enabled to those skilled in the art, which variations yet reside within the scope of the present teaching. Accordingly, the invention is to be broadly construed and limited only by the scope and spirit of the claims now appended hereto.

I claim:

1. A device securable to a relatively inflexible ski boot to facilitate safe walking therein, said device comprising:

a generally elastic member adapted to receive the bottom of said ski boot, said member including a first portion for receiving the toe of said boot, a second portion for receiving the heel of said boot, and an intermediate portion extending between said first and second portions; said toe and heel portions each including a platform projecting below said intermediate portion, said platforms thereby contacting the ground during the wearer walking to support the wearer and enable movement of the wearer's foot and limbs in a manner simulative of normal walking, without requiring flexure of said boot; said platform at said heel portion being substantially thicker than said platform at said toe portion, whereby said platform at said heel portion projects to a substantially lower point than said platform at said toe portion.

2. A device in accordance with claim 1, wherein the said platform at said heel portion is approximately twice the thickness of said platform of said toe portion.

3. A device in accordance with claim 2, wherein each of said platforms includes a layer of sponge rubber.

4. A device in accordance with claim 3, wherein the bottom of each said platform is provided with a surface including means to increase the frictional engagement with the underlying ground.

5. A device in accordance with claim 4, wherein each said surface is rippled.

6. A device in accordance with claim 1, including means for securing said device to portions of said boot.

7. A device in accordance with claim 6, wherein said securing means includes rings secured respectively to said toe and heel receiving portions; and means for engaging said rings and connecting same with portions of said boot.

8. A device in accordance with claim 7, wherein said connecting means comprises an elastic strap including fasteners at each end thereof, for engaging said rings and said boot portions.

9. A boot attachment for use with ski boots to facilitate walking in same, comprising:

a flexible sole piece; means defined at the front and rear ends of said sole piece for receiving the toe and heel portions of said boot; a first resilient support platform secured to and projecting beneath said sole piece at the toe-receiving end thereof; and a second resilient support platform secured to and projecting beneath said sole piece at the heel-receiving end thereof; the height of said second support platform substantially exceeding the height of said first support platform.

10. A device in accordance with claim 9, wherein each said platform includes an irregular bottom surface for increasing friction with the ground during use of said device.

11. A device in accordance with claim 9, further including fastener straps extending from said attachment, and engageable with portions of said boot.

* * * * *